US008838361B2

(12) United States Patent
Saito et al.

(10) Patent No.: US 8,838,361 B2
(45) Date of Patent: Sep. 16, 2014

(54) CONTROL APPARATUS FOR GENERAL-PURPOSE ENGINE

(75) Inventors: Shigeru Saito, Wako (JP); Tomoki Fukushima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 521 days.

(21) Appl. No.: 13/218,801

(22) Filed: Aug. 26, 2011

(65) Prior Publication Data

US 2012/0059569 A1 Mar. 8, 2012

(30) Foreign Application Priority Data

Sep. 8, 2010 (JP) ..... 2010-201467

(51) Int. Cl.

| | |
|---|---|
| ***B60T 7/12*** | (2006.01) |
| ***F02D 41/24*** | (2006.01) |
| ***F02D 31/00*** | (2006.01) |
| ***F02D 41/06*** | (2006.01) |

(52) U.S. Cl.

CPC ..... *F02D 41/068* (2013.01); *F02D 41/2451* (2013.01); *F02D 41/2441* (2013.01); *F02D 31/002* (2013.01)

USPC ..... 701/101; 701/104; 701/113; 123/434; 123/681; 123/685

(58) Field of Classification Search

CPC ..... F02D 41/068; F02D 41/08; F02D 41/083

USPC ..... 701/101, 103–105, 113; 123/434, 681, 123/683, 685, 491

See application file for complete search history.

(56) References Cited

U.S. PATENT DOCUMENTS

| | | | | |
|---|---|---|---|---|
| 6,397,818 | B1 * | 6/2002 | Price et al. | 123/406.55 |
| 6,520,160 | B2 * | 2/2003 | Kojima et al. | 123/492 |
| 6,588,402 | B2 * | 7/2003 | Price et al. | 123/406.55 |

(Continued)

FOREIGN PATENT DOCUMENTS

| | | |
|---|---|---|
| JP | 63-208637 A | 8/1988 |
| JP | 06-074319 A | 3/1994 |

(Continued)

OTHER PUBLICATIONS

Japanese Office Action dated Jul. 24, 2013, and English translation thereof, issued in Japanese Application No. 2010-201467.

*Primary Examiner* — John Kwon

(74) *Attorney, Agent, or Firm* — Westerman, Hattori, Daniels & Adrian, LLP

(57) ABSTRACT

In an apparatus for controlling a general-purpose engine used as a prime mover of an operating machine, the apparatus regulating a throttle opening such that an engine speed is converged to a desired engine speed, calculating a basic fuel injection amount based on the engine speed and throttle opening, and controlling engine warm-up operation by correcting the basic fuel injection amount with a correction coefficient to calculate a warm-up time fuel injection amount after engine start is completed and injecting fuel by the calculated amount, a fuel injection amount with which the engine output becomes maximum is searched based on the throttle opening regulated in response to increase/decrease operation of the warm-up time fuel injection amount conducted when the engine speed is constant; and the correction coefficient is corrected using the searched fuel injection amount. With this, a warm-up correction coefficient appropriate for the engine warm-up condition can be calculated.

12 Claims, 8 Drawing Sheets

(56) References Cited

U.S. PATENT DOCUMENTS

| | | | | |
|---|---|---|---|---|
| 6,634,167 | B1 * | 10/2003 | Toshioka et al. | 60/284 |
| 6,729,305 | B2 * | 5/2004 | Hoshi | 123/491 |
| 6,856,889 | B2 * | 2/2005 | Nagaishi et al. | 701/104 |
| 6,978,603 | B2 * | 12/2005 | Asanuma | 60/297 |
| 2011/0202259 | A1 * | 8/2011 | Fukushima et al. | 701/104 |
| 2012/0059570 | A1 * | 3/2012 | Hashizume et al. | 701/104 |

FOREIGN PATENT DOCUMENTS

| | | | |
|---|---|---|---|
| JP | 09-209795 | A | 8/1997 |
| JP | 2000-073927 | A | 3/2000 |
| JP | 2002-021607 | A | 1/2002 |
| JP | 2006-112357 | A | 4/2006 |
| JP | 2006-177290 | A | 7/2006 |
| JP | 2009-191628 | A | 8/2009 |

* cited by examiner

FIG.4

| ENGINE TEMPERATURE T [°C] | -25 | 0 | 25 | 50 | 100 |
|---|---|---|---|---|---|
| START FUEL INJECTION AMOUNT [$mm^3$] | 100 | 50 | 30 | 10 | 3 |

FIG.5

| ENGINE TEMPERATURE T [°C] | -25 | 0 | 25 | 50 | 100 |
|---|---|---|---|---|---|
| WARM-UP CORRECTION COEFFICIENT [FACTOR] | 1.4 | 1.3 | 1.2 | 1.1 | 1.0 |
| WARM-UP CORRECTION COEFFICIENT DECREASING AMOUNT [FACTOR] | 0.001 | 0.002 | 0.003 | 0.005 | 0 |

CONTROL APPARATUS FOR GENERAL-PURPOSE ENGINE

This application claims priority to Japanese Patent Application No. 2010-201467 filed on Sep. 8, 2010, which is hereby incorporated by reference herein in its entirety.

BACKGROUND

1. Technical Field

This embodiment relates to a control apparatus for a general-purpose internal combustion engine, particularly to an apparatus for controlling warm-up operation of the general-purpose internal combustion engine.

2. Background Art

Conventionally, there are proposed various engine warm-up operation control apparatuses that correct fuel injection amounts to increase during warm-up operation, as taught, for example, in Japanese Laid-Open Patent Application No. 2002-21607 (paragraphs 0003, 0025 to 0028, FIGS. 1 to 3, etc.). The technique in the reference is configured to increase a basic fuel injection amount calculated based on the engine speed, etc., by a correction amount set in accordance with an engine coolant temperature, etc., during the warm-up operation of a water-cooled engine.

SUMMARY

In the case of an air-cooled general-purpose engine, instead of using the engine coolant temperature, it is configured to calculate a warm-up correction coefficient based on a temperature of a cylinder head for instance and correct the basic fuel injection amount with the warm-up correction coefficient to calculate the fuel injection amount for the warm-up operation.

However, when, as in the foregoing, the warm-up correction coefficient is calculated based on the cylinder head temperature that tends to be influenced by the ambient temperature, it may not lead to an appropriate coefficient corresponding to the engine warm-up condition depending on the ambient temperature and consequently, the calculated fuel injection amount is not always appropriate for the warm-up condition. As a result, the warm-up operation may continue more than necessary and it results in the increase of fuel consumption, disadvantageously.

An object of the embodiment is therefore to overcome the foregoing problem by providing a control apparatus for a general-purpose engine that can calculate a warm-up correction coefficient appropriate for the engine warm-up condition to calculate an appropriate fuel injection amount.

In order to achieve the object, the embodiment provides in its first aspect an apparatus for controlling a general-purpose internal combustion engine connectable to an operating machine to be used as a prime mover of the machine, having: a throttle opening regulator adapted to regulate a throttle opening of a throttle valve installed in an air intake pipe of the engine such that a speed of the engine is converged to a desired engine speed set by an operator; a basic fuel injection amount calculator adapted to calculate a basic fuel injection amount based on the engine speed and the throttle opening; and a warm-up controller adapted to control warm-up operation of the engine by correcting the calculated basic fuel injection amount with a warm-up correction coefficient to calculate a warm-up time fuel injection amount after start operation of the engine is completed and injecting fuel from an injector by the calculated warm-up time fuel injection amount, wherein the improvement comprises: a maximum output fuel injection amount searcher adapted to search a fuel injection amount with which an output of the engine becomes maximum based on the throttle opening regulated in response to increasing/decreasing operation of the warm-up time fuel injection amount conducted when the engine speed is constant; and a warm-up correction coefficient corrector adapted to correct the warm-up correction coefficient using the searched fuel injection amount.

In order to achieve the object, the embodiment provides in its second aspect a method for controlling a general-purpose internal combustion engine connectable to an operating machine to be used as a prime mover of the machine, having the steps of: regulating a throttle opening of a throttle valve installed in an air intake pipe of the engine such that a speed of the engine is converged to a desired engine speed set by an operator; calculating a basic fuel injection amount based on the engine speed and the throttle opening; and controlling warm-up operation of the engine by correcting the calculated basic fuel injection amount with a warm-up correction coefficient to calculate a warm-up time fuel injection amount after start operation of the engine is completed and injecting fuel from an injector by the calculated warm-up time fuel injection amount, wherein the improvement comprises the steps of: searching a fuel injection amount with which an output of the engine becomes maximum based on the throttle opening regulated in response to increasing/decreasing operation of the warm-up time fuel injection amount conducted when the engine speed is constant; and correcting the warm-up correction coefficient using the searched fuel injection amount.

BRIEF DESCRIPTION OF DRAWINGS

The above and other objects and advantages will be more apparent from the following description and drawings in which:

FIG. 4 is an explanatory view showing mapped data used in the processing of the FIG. 3 flowchart;

FIG. 5 is an explanatory view showing mapped data used in the processing of the FIG. 3 flowchart;

DESCRIPTION OF EMBODIMENT

A control apparatus for a general-purpose engine according to an embodiment will now be explained with reference to the attached drawings.

Figure 1:
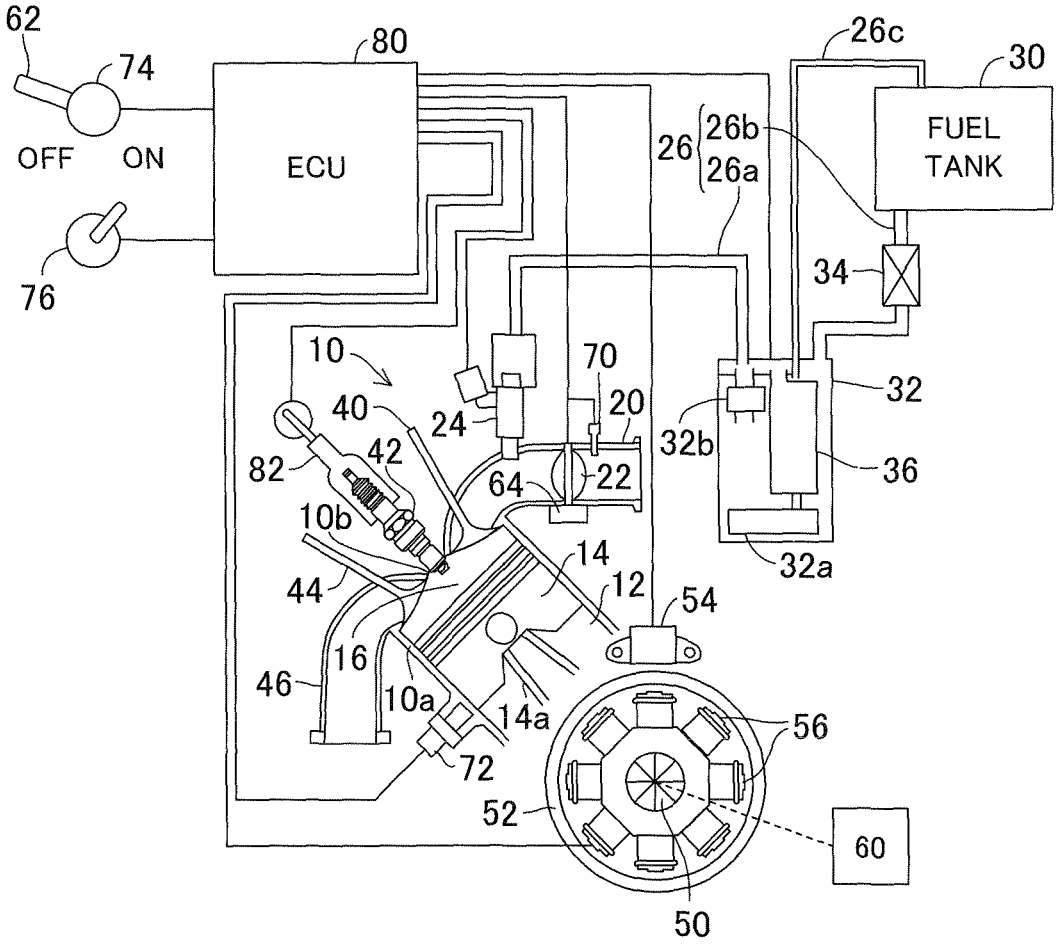
FIG. 1 is an overall view schematically showing a control apparatus for a general-purpose engine according to an embodiment.

In FIG. 1, reference numeral 10 designates a general-purpose engine (general-purpose internal combustion engine). The engine 10 is a gasoline-injection, single-cylinder, air-cooled, four-cycle, OHV engine with a displacement of, for example, 400 cc. The engine 10 comprises a general-purpose internal combustion engine usable as a prime mover of (connectable to) an industrial small operating machine for agricultural, constructional and other use.

A cylinder 12 formed in a cylinder block 10*a* of the engine 10 accommodates a piston 14 that reciprocates therein. A cylinder head 10*b* is attached to the cylinder block 10*a* and a combustion chamber 16 is formed between the cylinder head 10*b* and the crown of the piston 14.

The combustion chamber 16 is connected to an air intake pipe 20. The air intake pipe 20 is installed with a throttle valve 22 and at the downstream thereof, further installed with an injector 24 near an intake port. The injector 24 is connected to a fuel tank 30 through a fuel supply pipe 26.

To be more specific, the injector 24 is connected to a sub fuel tank 32 through a first fuel supply pipe 26*a* and the sub fuel tank 32 is connected to the fuel tank 30 through a second fuel supply pipe 26*b*.

The second fuel supply pipe 26*b* is interposed with a low-pressure pump 34 to pump fuel (gasoline) stored in the fuel tank 30 to be forwarded to the sub fuel tank 32. The sub fuel tank 32 is installed with a fuel pump (high-pressure pump) 36.

The fuel pump 36 pressurizes the fuel forwarded and filtered through a filter 32*a* and, as the fuel's pressure is regulated by a regulator 32*b*, pumps the fuel to be forwarded to the injector 24 through the fuel supply pipe 26*a*. A part of the fuel in the sub fuel tank 32 is returned to the fuel tank 30 through a return pipe 26*c*.

The intake air sucked through an air cleaner (not shown) is flown through the air intake pipe 20. After the flow rate is regulated by the throttle valve 22, the intake air reaches the intake port and is mixed with the fuel injected from the injector 24 to form the air-fuel mixture.

When an intake valve 40 is opened, the air-fuel mixture is flown into the combustion chamber 16 and ignited by a spark plug 42 to burn, thereby driving the piston 14. When an exhaust valve 44 is opened, the exhaust gas produced through the combustion is flown through an exhaust pipe 46 and discharged to the exterior.

A crankcase (not shown) is attached to the cylinder block 10*a* on the side opposite from the cylinder head 10*b* and houses a crankshaft 50 to be rotatable therein. The crankshaft 50 is connected to the piston 14 through a connecting rod 14*a* and rotated with the movement of the piston 14.

A camshaft (not shown) is rotatably housed in the crankcase to be parallel with the crankshaft 50 and connected via a gear mechanism (not shown) to the crankshaft 50 to be driven thereby. The camshaft is equipped with an intake cam and exhaust cam to open/close the intake valve 40 and exhaust valve 44 through a push rod and rocker arms (neither shown).

One end of the crankshaft 50 is attached with a flywheel 52. A pulsar coil (crank angle sensor) 54 is attached to the crankcase outside the flywheel 52. The pulsar coil 54 is rotated relative to a magnet (permanent magnet piece; not shown) attached on a top surface of the flywheel 52 and crosses the flux of the magnet, so that it produces one output per one rotation (360 degrees) of the crankshaft 50 at a predetermined crank angle near the top dead center.

Power coils (generator coils) 56 are attached in the inside of the crankcase and are rotated relative to eight magnets (permanent magnet piece; not shown) attached on a back surface of the flywheel 52 to produce electromotive forces by crossing the flux of the magnets. Thus the power coils 56 function as an Alternating-Current Generator (ACG). The produced electromotive force is rectified and then supplied to a battery (not shown) to charge it.

The other end of the crankshaft 50 is connected to a load 60 such as an operating machine. In this embodiment, a term of "load" means a machine or equipment that consumes power or energy (output) generated by a prime mover, or an amount or magnitude of power consumed by the machine.

An accelerator lever 62 is installed at an appropriate position on a housing (not shown) of the engine 10 to be manipulated by the operator (user). The lever 62 comprises a knob to be pinched by the operator's fingers, so that the operator can input a command for establishing a desired engine speed Nd by turning the knob within a range between predefined minimum and maximum engine speeds.

The throttle valve 22 is connected to an electric motor (actuator, more exactly, a stepper motor; throttle opening regulator) 64. The motor 64 opens/closes or regulates the throttle valve 22 independently from the manipulation of the accelerator lever 62 by the operator. Specifically, the throttle valve 22 is of a Drive-By-Wire type.

An intake air temperature sensor 70 comprising a thermistor or the like is installed in the air intake pipe 20 at the upstream of the throttle valve 22 and produces an output or signal indicative of a temperature of intake air flowing therethrough. An engine temperature sensor 72 comprising a thermistor or the like is installed at the cylinder block 10*a* at a position near the cylinder head 10*b* and produces an output or signal indicative of a temperature of the installed position, i.e., a temperature T of the engine 10 (engine temperature, more precisely a temperature of the cylinder head lob).

A variable resistor (potentiometer) 74 is connected to the accelerator lever 62 to produce an output or signal representing the desired engine speed Nd set by the operator through the manipulation of the lever 62. A manipulation switch 76 to be manipulated by the operator is installed at an appropriate position on the housing of the engine 10.

The manipulation switch 76 produces an output or signal indicating an operation command when being manipulated to an ON position (made ON) by the operator and a stop command when being manipulated to an OFF position (made OFF).

The outputs of the foregoing sensors 70, 72, 74, switch 76, pulsar coil 54 and power coils 56 are sent to an Electronic Control Unit (ECU) 80 comprising a microcomputer having a CPU, ROM, RAM and input/output circuits. Based on the outputs, the ECU 80 controls the operation of the injector 24, spark plug 42, motor 64, etc.

Figure 2:
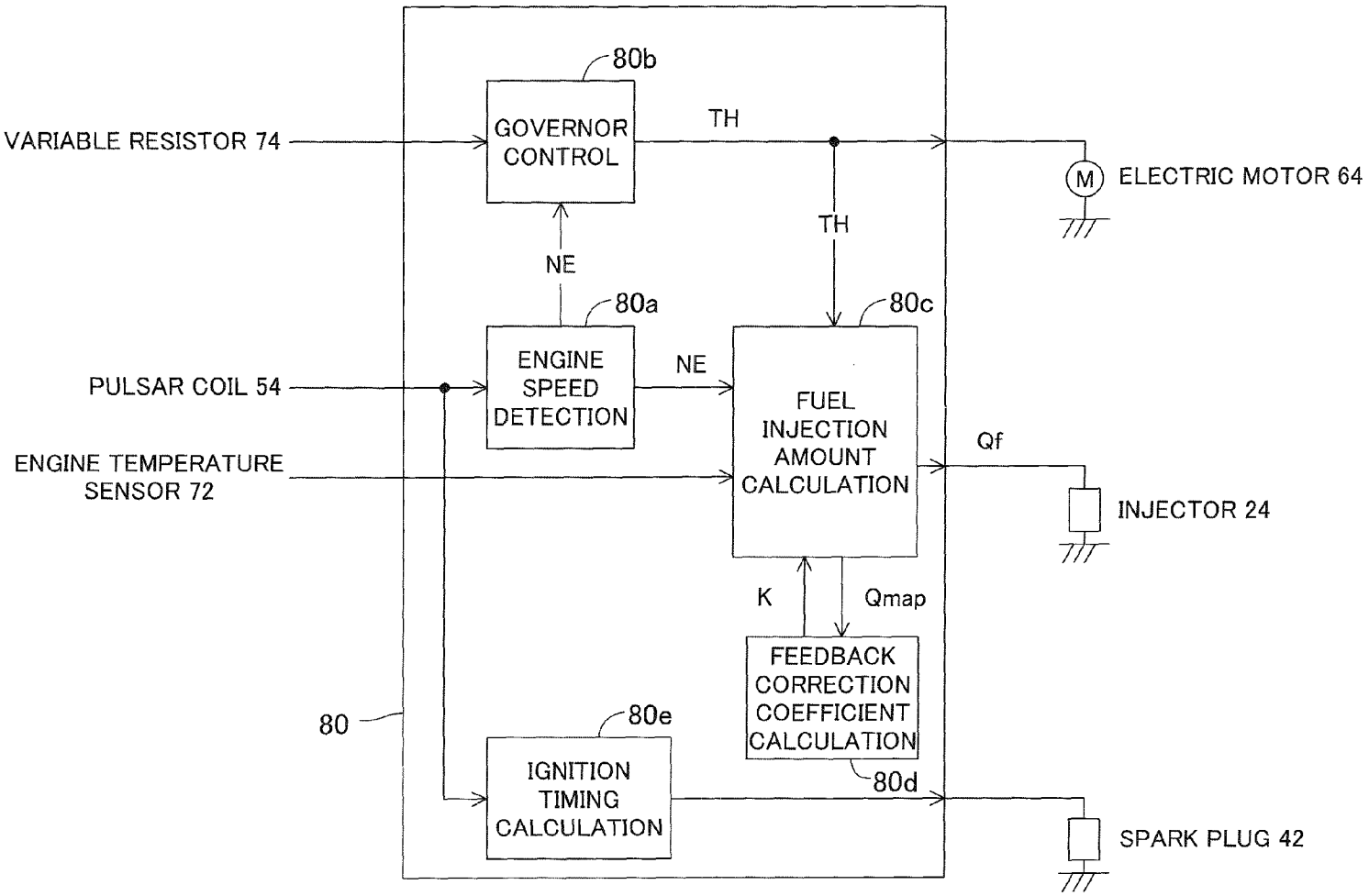
FIG. 2 is a block diagram mainly showing the configuration of an Electronic Control Unit (ECU) shown in FIG. 1.

FIG. 2 is a block diagram mainly showing the configuration of the ECU 80. The ECU 80 comprises an engine speed detection block 80*a*, governor control block 80*b*, fuel injection amount calculation block 80*c*, feedback correction coefficient calculation block 80*d* and ignition timing calculation block 80*e*.

The engine speed detection block 80*a* counts outputs of the pulsar coil 54 to detect the engine speed NE. The engine speed NE may be detected using the outputs of the power coils 56.

The governor control block 80*b* determines the desired engine speed Nd of the engine 10 based on the output of the variable resistor 74 produced in response to the manipulation of the lever 62 and regulates a throttle opening so that the engine speed NE inputted from the engine speed detection block 80*a* becomes (converges to) the desired engine speed Nd.

Specifically, when the detected engine speed NE is lower than the desired engine speed Nd, the governor control block 80*b* outputs a throttle opening command value TH that is increased from a present value TH by a predetermined opening. In contrast, when the engine speed NE is higher than the desired engine speed Nd, it outputs the throttle opening command value TH that is decreased from the present value TH by a predetermined opening. The outputted throttle opening command value TH is sent to the motor 64 so that the throttle opening is regulated through the motor 64. In other words, the engine 10 according to this embodiment includes an electronic governor having the motor 64, ECU 80, etc.

Since the ECU 80 thus instructs a rotational amount of the motor 64, it can calculate or detect the opening of the throttle valve 22 (throttle opening) based on the command value TH produced by itself, without a throttle opening sensor. The throttle opening is calculated by obtaining a percentage when defining the fully-closed position or thereabout as 0 and the fully-opened position or thereabout as 100.

The fuel injection amount calculation block 80*c* calculates a map fuel injection amount Qmap based on the engine speed NE detected by the engine speed detection block 80*a* and the throttle opening command value TH inputted from the governor control block 80*b* in accordance with a fuel injection amount map (mapped data or mapped values; characteristics) set beforehand. The map is set by experimentally obtaining fuel injection amounts that enable to achieve the air/fuel ratio (so-called the output air/fuel ratio) with which the engine output can be maximum under an ideal condition (e.g., ambient temperature: 25° C., altitude: 0 meter, humidity: 0%). The output air/fuel ratio is determined to be on the richer side than the stoichiometric air/fuel ratio.

Further, the fuel injection amount calculation block 80*c* detects the engine temperature T based on the output of the engine temperature sensor 72 and calculates a warm-up correction coefficient based on the detected engine temperature T in accordance with a warm-up correction coefficient map (mapped data or mapped values; characteristics) set beforehand. The map is set by experimentally obtaining warm-up correction coefficients that enable to achieve the air/fuel ratio (output air/fuel ratio) with which the engine output can be maximum in the warm-up operation under the ideal condition, similarly to the case of the fuel injection amount map.

The fuel injection amount calculation block 80*c* sends the map fuel injection amount Qmap to the feedback correction coefficient calculation block 80*d*. The feedback correction coefficient calculation block 80*d* calculates a feedback correction coefficient K based on the map fuel injection amount Qmap, etc., in the manner explained later and sends it to the fuel injection amount calculation block 80*c*.

Until the feedback correction coefficient K is inputted during the warm-up operation after the engine start, the fuel injection amount calculation block 80*c* calculates a fuel injection amount applied during the warm-up operation (hereinafter called the "warm-up time fuel injection amount") in accordance with the fuel injection amount map and warm-up correction coefficient map.

To be specific, the fuel injection amount calculation block 80*c* calculates a basic fuel injection amount by retrieving the fuel injection amount map using the engine speed NE and throttle opening command value TH, i.e., by using a method called a throttle speed method, while calculating the warm-up correction coefficient by retrieving the warm-up correction coefficient map using the engine temperature T. Then it calculates the warm-up time fuel injection amount by multiplying the basic fuel injection amount by the warm-up correction coefficient and sends the obtained product as a final fuel injection amount command value Qf to the injector 24. The injector 24 stays open for a period determined by the sent command value Qf to inject the fuel.

On the other hand, upon receipt of the feedback correction coefficient K, the fuel injection amount calculation block 80*c* multiplies each coefficient in the warm-up correction coefficient map by the inputted coefficient K to correct (rebuild) the map. Then it calculates the warm-up correction coefficient in accordance with the corrected map and calculates the warm-up time fuel injection amount by multiplying the basic fuel injection amount by the obtained coefficient. The calculation of the warm-up time fuel injection amount will be explained later.

The ignition timing calculation block 80*e* calculates the ignition timing based on the output of the pulsar coil 54, etc., and controls the ignition operation of the spark plug 42 through an ignition device 82 such as an ignition coil. The fuel injection and ignition operation are carried out in response to the output of the pulsar coil 54.

Figure 3:
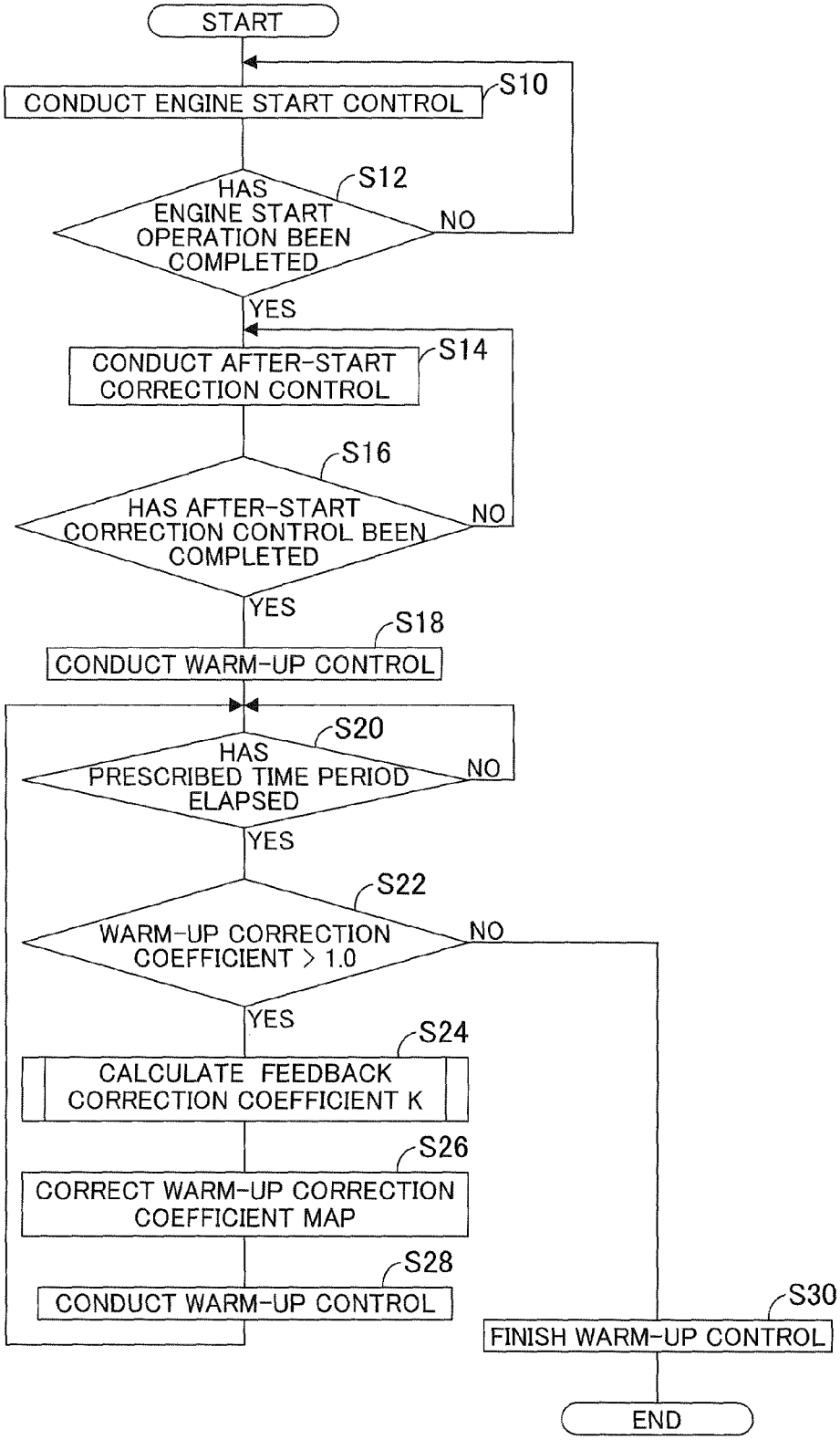
FIG. 3 is a flowchart showing fuel injection amount warm-up correction processing of the apparatus shown in FIG. 1.

FIG. 3 is a flowchart showing fuel injection amount warm-up correction processing conducted from when the manipulation switch 76 is made ON until when the warm-up operation of the engine 10 is completed, among the operation executed by the ECU 80.

The program begins at S(step)10, in which engine start control for injecting the fuel from the injector 24 by a start fuel injection amount calculated based on the engine temperature T is conducted to increase the fuel injection amount. Specifically, the start fuel injection amount is calculated by retrieving a start fuel injection amount map shown in FIG. 4 using the engine temperature T at the beginning of the engine start, and the fuel is injected from the injector 24 by the calculated start fuel injection amount. The start fuel injection amount is an amount necessary for the start operation of the engine 10 and, as illustrated, set to be decreased stepwise or in stages with increasing temperature T.

Next the program proceeds to S12, in which it is determined whether the start operation of the engine 10 has been completed, i.e., whether the engine speed NE has reached the self-rotational speed (e.g., 1000 rpm). When the result in S12 is negative, the program returns to S10, while, when the result is affirmative, proceeding to S14, in which after-start correction control for increasing the fuel injection amount is conducted.

In the after-start correction control, the fuel is injected from the injector 24 by the fuel injection amount obtained by multiplying the basic fuel injection amount calculated based on the engine speed NE and throttle opening (precisely, throttle opening command value TH) by an after-start correction coefficient calculated based on the engine temperature T. The after-start correction coefficient composed of a multiplication term equal to or greater than 1.0 is set to be gradually decreased with increasing temperature T.

Then the program proceeds to S16, in which it is determined whether the after-start correction control has been completed, i.e., whether the warm-up correction coefficient is greater than the after-start correction coefficient. When the result in S16 is negative, the processing of S14 is repeated and when the result is affirmative, the program proceeds to S18, in which the warm-up control is conducted, i.e., the warm-up time fuel injection amount is calculated by correcting the basic fuel injection amount with the warm-up correction coefficient so that the fuel is injected from the injector 24 by the calculated amount.

In the warm-up control, the warm-up time fuel injection amount is calculated through the following Equation 1.

$$\text{Warm-up time fuel injection amount} = \text{Basic fuel injection amount} \times \text{Warm-up correction coefficient} \quad \text{Eq. 1}$$

In the above equation, the warm-up correction coefficient is calculated by retrieving the warm-up correction coefficient map (before corrected) shown in FIG. 5 using the engine temperature T. As illustrated, the warm-up correction coefficient composed of a multiplication term equal to or greater than 1.0 is set to be gradually decreased with increasing temperature T.

Further, the warm-up correction coefficient is set to decrease toward 1.0 by a warm-up correction coefficient decreasing amount (predetermined value) every time the engine 10 is rotated a predetermined number of times (e.g., once). The warm-up correction coefficient decreasing amount is calculated by retrieving a warm-up correction coefficient decreasing amount map shown in FIG. 5 using the engine temperature T. The decreasing amount is gradually increased in proportion to the increase in the temperature T and becomes 0 when the temperature T is at a value (e.g., 100° C.) which enables to estimate that the warm-up operation has been completed.

Specifically, the warm-up correction coefficient in the Equation 1 is calculated through the following Equation 2 every time the engine 10 is rotated the predetermined number of times.

$$\text{Warm-up correction coefficient} = (\text{previous})\ \text{Warm-up correction coefficient} - \text{Warm-up correction coefficient decreasing amount} \quad \text{Eq. 2}$$

Since the warm-up correction coefficient is thus decreased, the warm-up time fuel injection amount in the Equation 1 is gradually decreased with time. Instead of using the rotation of the engine 10, the warm-up correction coefficient may be set to decrease by the warm-up correction coefficient decreasing amount every time a predetermined time period elapses.

Next, the program proceeds to S20, in which it is determined whether a prescribed time period (e.g., 15 seconds) has elapsed since the warm-up control was started. When the result in S20 is negative, the foregoing processing is repeated and when the result is affirmative, the program proceeds to S22, in which it is determined whether the present warm-up correction coefficient is greater than 1.0.

When the result in S22 is affirmative, the program proceeds to S24, in which calculation processing of the feedback correction coefficient K is conducted.

Figure 6:
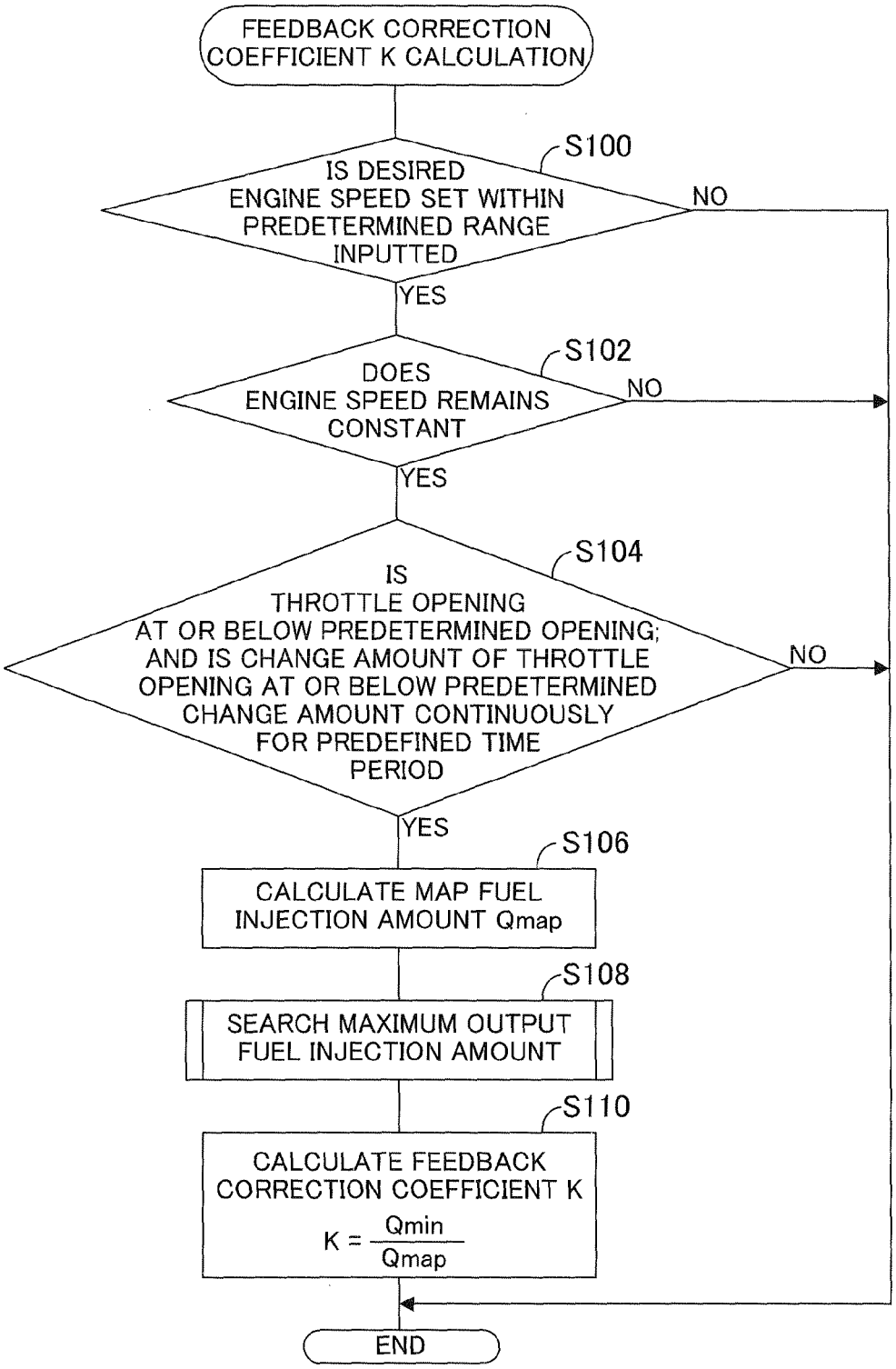
FIG. 6 is a subroutine flowchart showing feedback correction coefficient calculation processing of FIG. 3.

FIG. 6 is a subroutine flowchart showing the processing.

First in S100, it is determined whether the desired engine speed Nd set within a predetermined range is inputted, i.e., whether the accelerator lever 62 is positioned within a range between 1000 rpm and 3000 rpm for instance.

When the result in S100 is affirmative, the program proceeds to S102, in which it is determined whether the detected engine speed NE remains constant, more precisely, exhibits a value at the desired engine speed Nd or thereabout continuously for a predefined time period. For example, when the engine speed NE falls within a range of plus or minus 200 rpm of the desired engine speed Nd continuously for 5 seconds, the engine speed NE is determined to be constant.

When the result in S102 is affirmative, the program proceeds to S104, in which it is determined whether the throttle opening (i.e., throttle opening command value TH) is equal to or less than a predetermined throttle opening and a change amount of the throttle opening (i.e., throttle opening command value TH) is equal to or less than a predetermined change amount continuously for the predefined time period. For instance, in S104, it is determined whether the throttle opening is equal to or less than an opening of 30% and determined whether the change amount of the throttle opening is within a range of plus or minus 1% continuously for 5 seconds.

When the result in any of steps of S100 to S104 is negative, the remaining steps are skipped. When the result in S104 is affirmative, i.e., when the engine speed NE is constant and a load connected to the engine 10 is also constant, the program proceeds to S106, in which the map fuel injection amount Qmap is calculated, i.e., it is calculated in accordance with the fuel injection amount map based on the engine speed NE and throttle opening command value TH that are detected under the condition where the engine speed NE stays constant.

Next the program proceeds to S108, in which processing for searching (detecting) the fuel injection amount with which the engine output becomes maximum is conducted. Specifically, since the engine 10 is used as a prime mover of a small operating machine, it is preferable to operate the engine 10 with the fuel injection amount that enables to achieve the output air/fuel ratio at which the engine output can be maximum. However, the output air/fuel ratio changes depending on the warm-up condition of the engine 10 (more precisely, the progress thereof). Therefore, in order to correct the fuel injection amount to be the one suitable for the warm-up condition of the engine 10, in S108, the fuel injection amount with which the engine output becomes maximum is searched.

Figure 7:
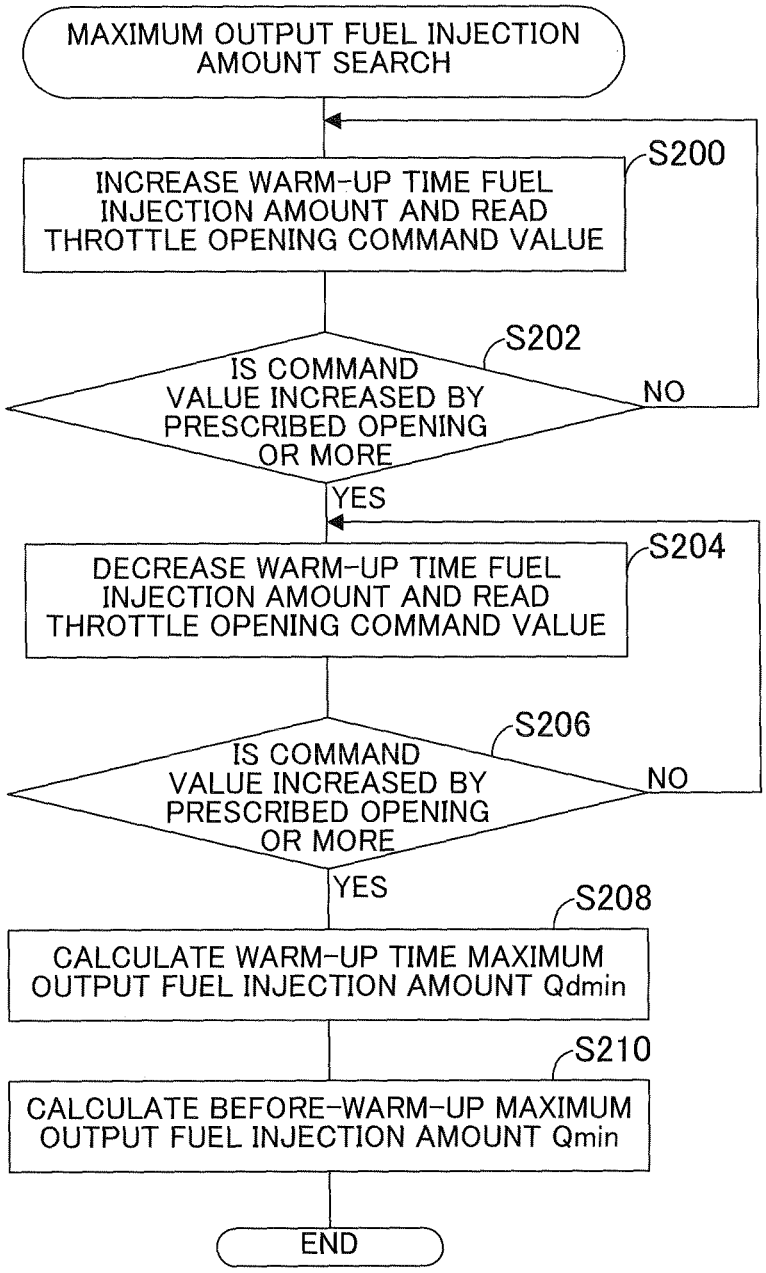
FIG. 7 is a subroutine flowchart showing maximum output fuel injection amount search processing of FIG. 6.

FIG. 7 is a subroutine flowchart showing the maximum output fuel injection amount search processing.

Before explaining the FIG. 7 flowchart, a principle of the maximum output fuel injection amount search will be explained.

Figure 8:
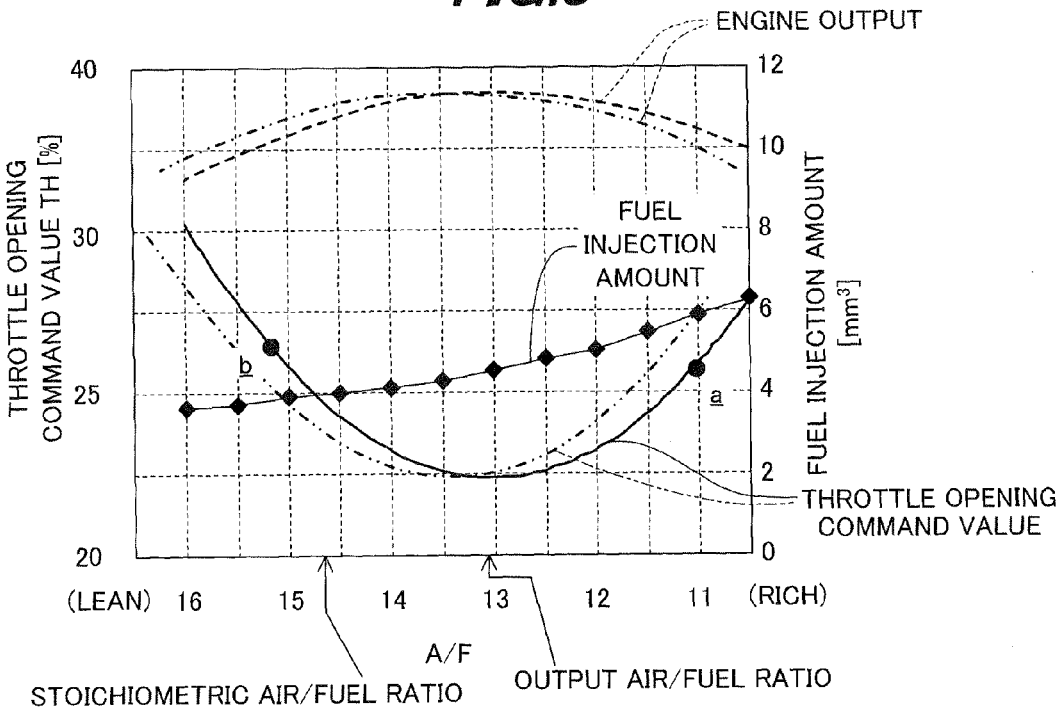
FIG. 8 is a graph for explaining the principle of the maximum output fuel injection amount search of FIG. 7.

FIG. 8 is a graph for explaining the principle. The abscissa indicates the air/fuel ratio A/F and a dashed line represents the output characteristics of the engine 10 relative to the air/fuel ratio A/F. Generally, the engine output becomes maximum at a specific air/fuel ratio on the richer side than the stoichiometric air/fuel ratio (A/F=14.7 (in mass ratio)). Hence, as the air/fuel ratio is changed to the leaner or richer side from the specific air/fuel ratio (i.e., output air/fuel ratio) at which the engine output becomes maximum, the engine output is decreased.

Meanwhile, when it is under the condition where the engine speed NE is constant and the load connected to the engine 10 is also constant, the throttle opening command value TH is kept at a substantially constant value through electronic governor control.

Under the above condition, when the warm-up time fuel injection amount is intentionally increased/decreased, i.e., when the air/fuel ratio is changed, the engine output is changed accordingly so that the engine speed NE is also changed. Consequently, in order to keep the engine speed NE at the desired engine speed Nd, the throttle opening command value TH is changed through the electronic governor control. Specifically, as illustrated, when the warm-up time fuel injection amount is increased/decreased, the throttle opening command value TH exhibits the minimum value at a point corresponding to the output air/fuel ratio and is increased in the richer or leaner air/fuel ratio direction.

Therefore, if the warm-up time fuel injection amount is intentionally increased/decreased under the condition where the engine speed NE and load are constant to obtain the minimum value of the throttle opening command value TH, it makes possible to search the fuel injection amount that can achieve the output air/fuel ratio.

Returning to the explanation on FIG. 7, in S200, while the warm-up time fuel injection amount is increased, the throttle opening command value TH is read. To be specific, the fuel injection amount is increased by 5% per second and the throttle opening command value TH regulated in response thereto is read every 100 milliseconds to calculate an average of the command value TH over 1 second. The increased fuel injection amount of injected fuel and the average of the throttle opening command value TH are stored in a memory successively.

Next the program proceeds to S202, in which it is determined whether the throttle opening command value TH is increased by a prescribed opening or more, i.e., whether the command value TH (average) after increasing the fuel injection amount is increased by 10% or more from the command value TH (average) calculated before increasing the fuel injection amount. In the case of FIG. 8, it is determined whether the command value TH is at a point a or thereabout.

When the result in S202 is negative, the program returns to S200 and when the result is affirmative, proceeds to S204, in which, while conversely the warm-up time fuel injection amount is decreased, the throttle opening command value TH is read. To be specific, the fuel injection amount is decreased by 5% per second and the throttle opening command value TH regulated in response thereto is read every 100 milliseconds to calculate the average of the command value TH over 1 second. The decreased fuel injection amount of injected fuel and the average of the throttle opening command value TH are stored in the memory successively.

Next the program proceeds to S206, in which it is determined whether the throttle opening command value TH is increased by a prescribed opening or more, i.e., whether the command value TH (average) after decreasing the fuel injection amount is increased by 5% or more from the command value TH (average) calculated before decreasing the fuel injection amount. In the case of FIG. 8, it is determined whether the command value TH is at a point b or thereabout.

Figure 9:
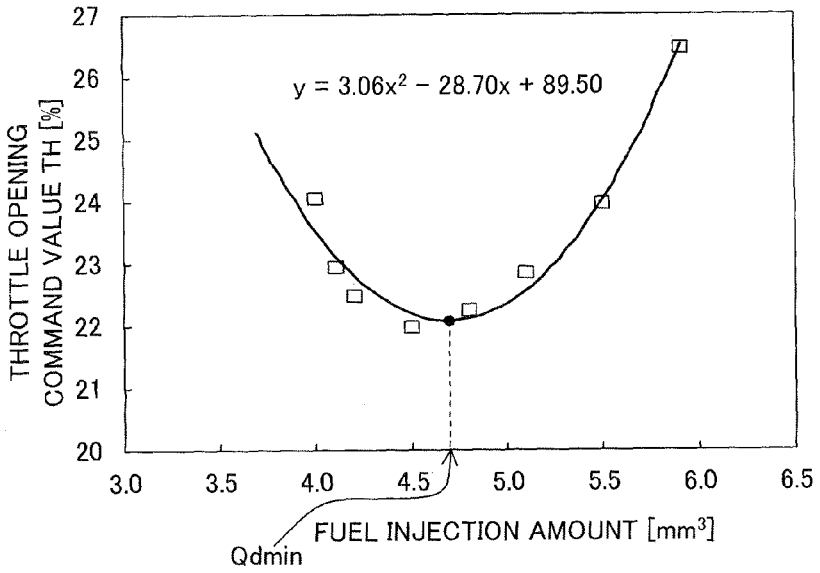
FIG. 9 is a graph for explaining calculation of a warm-up time maximum output fuel injection amount of FIG. 7.

When the result in S206 is negative, the program returns to S204 and when the result is affirmative, proceeds to S208, in which a warm-up time maximum output fuel injection amount (output air/fuel ratio fuel injection amount) Qdmin is calculated. Specifically, as shown in FIG. 9, the increased/decreased injection amount of injected fuel and the throttle opening command value TH (average) at the time of the fuel injection are plotted. Subsequently, the characteristics of the change of the throttle opening command value TH are approximated as a quadratic curve with the least squares method. Then, the minimum value of the throttle opening command value TH in the approximated quadratic curve is determined and the fuel injection amount corresponding to the minimum value of the command value TH is obtained. This fuel injection amount corresponding to the minimum value of the command value TH is the aforesaid fuel injection amount that enables to achieve the output air/fuel ratio, i.e., the warm-up time maximum output fuel injection amount Qdmin.

Next the program proceeds to S210, in which a before-warm-up maximum output fuel injection amount Qmin is calculated by dividing the warm-up time maximum output fuel injection amount Qdmin by the present warm-up correction coefficient.

Returning to the explanation on the FIG. 6 flowchart, the program proceeds to S110, in which the feedback correction coefficient K is calculated. The coefficient K is calculated in accordance with the equation shown in the drawing based on a ratio of the map fuel injection amount Qmap calculated in S106 to the maximum output fuel injection amount Qmin calculated in S210.

Specifically, the coefficient K represents a degree of deviation between the fuel injection amount with which the output air/fuel ratio is achieved under the ideal condition (i.e., the condition when the fuel injection amount map is prepared) and the fuel injection amount with which the output air/fuel ratio is actually achieved, i.e., corresponding to the actual warm-up condition of the engine 10.

In the FIG. 3 flowchart, the program proceeds to S26, in which the warm-up correction coefficient map is corrected or rebuilt, i.e., it is corrected to be suited for the warm-up condition of the engine 10 by multiplying the mapped values set under the ideal condition by the coefficient K.

Next the program proceeds to S28, in which the warm-up control is conducted using the corrected warm-up correction coefficient map. Specifically, in S28, similarly to in S18, the basic fuel injection amount is calculated by retrieving the fuel injection amount map using the engine speed NE and throttle opening (precisely, the throttle opening command value TH) and the warm-up correction coefficient is calculated by retrieving the corrected warm-up correction coefficient map using the engine temperature T. Then the warm-up time fuel injection amount is newly calculated by multiplying the basic fuel injection amount by the warm-up correction coefficient.

Thus the warm-up correction coefficient map is corrected based on the warm-up time maximum output fuel injection amount Qdmin searched in S200 to S208 (more exactly, the maximum output fuel injection amount Qmin calculated therefrom (S210)) and the warm-up correction coefficient is newly obtained from the corrected warm-up correction coefficient map, i.e., the warm-up correction coefficient calculated in S18 is corrected in S28.

After that, the program returns to S20 to repeat the processing of S22 to S28 every time the prescribed time period elapses. Specifically, the warm-up time fuel injection amount is increased/decreased to search the maximum output fuel injection amount Qdmin and based thereon, the warm-up correction coefficient is corrected every prescribed time period, thereby responding to the change in the warm-up condition of the engine 10.

When the warm-up correction coefficient is decreased through the calculation of the Equation 2 so that the result in S22 becomes negative, i.e., when the coefficient becomes 1.0 or less, the program proceeds to S30, in which the warm-up control is finished and the program is terminated. In other words, the warm-up control is continued until the warm-up correction coefficient reaches 1.0. Although the normal fuel injection control is performed after the warm-up operation, since it is not directly related to the gist of this invention, the explanation thereof is omitted.

Figure 10:
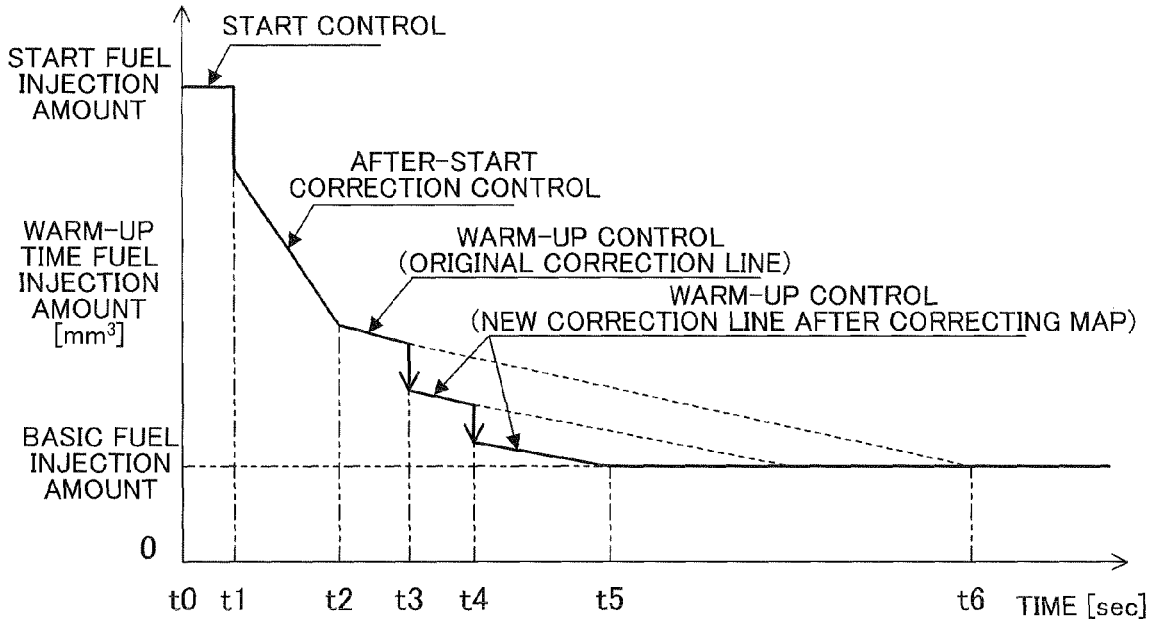
FIG. 10 is a time chart for explaining the processing of FIGS. 3, 6 and 7.

FIG. 10 is a time chart for explaining the foregoing processing.

First, when the manipulation switch 76 is made ON at the time t0, the start control for injecting the fuel from the injector 24 by the start fuel injection amount is conducted (S10). Next, when the start operation of the engine 10 is completed at the time t1 (S12), the after-start correction control for injecting the fuel from the injector 24 by the fuel injection amount obtained by multiplying the basic fuel injection amount by the after-start correction coefficient is conducted (S14).

When the after-start correction control is completed at the time t2 (S16), the warm-up control for injecting the fuel from the injector 24 by the warm-up time fuel injection amount calculated by correcting the basic fuel injection amount with the warm-up correction coefficient is started (S18). Since the warm-up correction coefficient is set to decrease by the warm-up correction coefficient decreasing amount every time the engine 10 is rotated the predetermined number of times, the warm-up time fuel injection amount is also gradually decreased.

When the prescribed time period has elapsed since the warm-up control was started (S20), the warm-up time fuel injection amount is increased/decreased and based on the throttle opening regulated with the increase/decrease, the maximum output fuel injection amount Qdmin with which the engine output becomes maximum is searched. The warm-up correction coefficient map is corrected using the value Qdmin to correct the warm-up correction coefficients and the warm-up time fuel injection amount is newly calculated using the corrected coefficient and the basic fuel injection amount. Then the fuel is injected from the injector 24 (S24 to S28; time t3).

When the prescribed time period has elapsed since the time t3 (S20), the warm-up time fuel injection amount is increased/decreased to again correct the warm-up correction coefficient (time t4). To be specific, as indicated by imaginary lines in FIG. 8, the output air/fuel ratio may be shifted leftward in the drawing (i.e., to the leaner side) depending on the warm-up condition of the engine 10. In this case, the warm-up time fuel injection amount is increased/decreased to search the maximum output fuel injection amount Qdmin to again correct the warm-up correction coefficient.

When, at the time t5, the warm-up correction coefficient reaches 1.0, the warm-up control is finished. In other words, the warm-up control is continued until the coefficient reaches 1.0 (S22, S30).

As is clear from FIG. 10, in the case where the warm-up control is continued with the warm-up time fuel injection amount initially calculated at the time t2, the warm-up control is to be finished at the time t6 as indicated by a dashed line. Compared to this, when the warm-up correction coefficient is corrected by correcting the map in accordance with the warm-up condition of the engine 10 (by correcting it twice at the times t3 and t4 in the case of FIG. 10), the warm-up control is finished at the time t5, thereby enabling to shorten the warm-up operation time.

As stated above, the embodiment is configured to have an apparatus and a method for controlling a general-purpose internal combustion engine 10 connectable to an operating machine (load 60) to be used as a prime mover of the machine, having: a throttle opening regulator (electric motor 64, ECU 80) adapted to regulate a throttle opening (throttle opening command value) TH of a throttle valve 22 installed in an air intake pipe 20 of the engine such that a speed NE of the engine is converged to a desired engine speed Nd set by an operator; a basic fuel injection amount calculator (ECU 80, S18, S28) adapted to calculate a basic fuel injection amount based on the engine speed and the throttle opening; and a warm-up controller (ECU 80, S18, S28) adapted to control warm-up operation of the engine by correcting the calculated basic fuel injection amount with a warm-up correction coefficient to calculate a warm-up time fuel injection amount after start operation of the engine is completed and injecting fuel from an injector 24 by the calculated warm-up time fuel injection amount, wherein the improvement comprises: a maximum output fuel injection amount searcher (ECU 80, S24, S102, S108, S200 to S210) adapted to search a fuel injection amount (maximum output fuel injection amount) Qdmin with which an output of the engine becomes maximum based on the throttle opening regulated in response to increasing/decreasing operation of the warm-up time fuel injection amount conducted when the engine speed is constant; and a warm-up correction coefficient corrector (ECU 80, S26, S28) adapted to correct the warm-up correction coefficient using the searched fuel injection amount Qdmin.

With this, it becomes possible to calculate the appropriate fuel injection amount using the warm-up correction coefficient corrected (calculated) in accordance with the warm-up (operating) condition of the engine 10, thereby enabling to shorten the warm-up operation time and decrease the fuel consumption.

Further, even when the engine 10 comprises the air-cooled general purpose engine whose warm-up condition (the progress of whose warm-up operation) is easily influenced by the ambient temperature, owing to the above configuration, it becomes possible to calculate the appropriate fuel injection amount in accordance with the warm-up condition.

In the apparatus and method, the warm-up correction coefficient is set to decrease by a predetermined value (warm-up correction coefficient decreasing amount) every time the engine is rotated a predetermined number of times.

In the apparatus and method, the warm-up correction coefficient is set to decrease by a predetermined value (warm-up correction coefficient decreasing amount) every time a predetermined time period elapses.

With this, since the warm-up correction coefficient can be decreased gradually (in stages) with time (as the engine 10 is warmed up), it becomes possible to calculate the appropriate fuel injection amount in accordance with the engine warm-up condition.

In the apparatus and method, the maximum output fuel injection amount searcher searches the fuel injection amount Qdmin with which the output of the engine becomes maximum by increasing/decreasing the warm-up time fuel injection amount every prescribed time period (S20 to S28). With this, since the coefficient is corrected every prescribed time period (periodically), it becomes possible to calculate the further appropriate fuel injection amount in accordance with the engine warm-up condition.

In the apparatus and method, the maximum output fuel injection amount searcher searches the fuel injection amount Qdmin with which the output of the engine becomes maximum based on a minimum value of the throttle opening regulated in response to the increasing/decreasing operation of the warm-up time fuel injection amount (S24, S108, S208). Specifically, in the case where the fuel injection amount is increased/decreased with the constant engine speed NE, the engine output becomes maximum with the minimum throttle opening TH. Since it is configured to retrieve the fuel injection amount Qdmin based on the above characteristic, it becomes possible to accurately search the fuel injection amount with which the engine output becomes maximum, with the simple structure.

In the apparatus and method, the warm-up correction coefficient is composed of a multiplication term equal to or greater than 1.0 and set to decrease toward 1.0 by the predetermined value (warm-up correction coefficient decreasing amount) every time the engine is rotated the predetermined number of times, and the warm-up controller continues the warm-up operation until the warm-up correction coefficient reaches 1.0 (S22, S30).

In the apparatus and method, the warm-up correction coefficient is composed of a multiplication term equal to or greater than 1.0 and set to decrease toward 1.0 by the predetermined value (warm-up correction coefficient decreasing amount) every time the predetermined time period elapses, and the warm-up controller continues the warm-up operation until the warm-up correction coefficient reaches 1.0 (S22, S30).

With this, the warm-up correction coefficient can be gradually decreased toward 1.0 as the engine 10 is warmed up and consequently, it becomes possible to calculate the further appropriate fuel injection amount in accordance with the engine warm-up condition. Also, since the warm-up control is continued until the coefficient reaches 1.0, the warm-up operation can be finished at the right time, i.e., when it is completed.

It should be noted that although the warm-up correction coefficient and after-start correction coefficient are composed of multiplication terms, they may be addition terms. Further, although the warm-up correction coefficient, warm-up correction coefficient decreasing amount, start fuel injection amount, etc., are indicated with specific values in the foregoing, they are only examples and not limited thereto.

Japanese Patent Application No. 2010-201467 filed on Sep. 8, 2010, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling a general-purpose internal combustion engine connectable to an operating machine to be used as a prime mover of the machine, having:

a throttle opening regulator adapted to regulate a throttle opening of a throttle valve installed in an air intake pipe of the engine such that a speed of the engine is converged to a desired engine speed set by an operator;

a basic fuel injection amount calculator adapted to calculate a basic fuel injection amount based on the engine speed and the throttle opening; and a warm-up controller adapted to control warm-up operation of the engine by correcting the calculated basic fuel injection amount with a warm-up correction coefficient to calculate a warm-up time fuel injection amount after start operation of the engine is completed, and by injecting fuel from an injector by the calculated warm-up time fuel injection amount, wherein the improvement comprises:

a maximum output fuel injection amount searcher adapted to search for a searched fuel injection amount with which an output of the engine becomes maximum based on the throttle opening regulated in response to increasing/decreasing operation of the warm-up time fuel injection amount conducted when the engine speed is constant; and a warm-up correction coefficient corrector adapted to correct the warm-up correction coefficient using the searched fuel injection amount, and wherein the maximum output fuel injection amount searcher searches the fuel infection amount with which the output of the engine becomes maximum based on a minimum value of the throttle opening regulated in response to the increasing/decreasing operation of the warm-up time fuel injection amount.

2. The apparatus according to claim 1, wherein the warm-up correction coefficient is set to decrease by a predetermined value every time the engine is rotated a predetermined number of rotations.

3. The apparatus according to claim 1, wherein the warm-up correction coefficient is set to decrease by a predetermined value every predetermined time period.

4. The apparatus according to claim 1, wherein the maximum output fuel injection amount searcher searches the fuel injection amount with which the output of the engine becomes maximum by increasing/decreasing the warm-up time fuel injection amount every prescribed time period.

5. The apparatus according to claim 2, wherein the warm-up correction coefficient is composed of a multiplication term equal to or greater than 1.0 and set to decrease toward 1.0 by the predetermined value every time the engine is rotated the predetermined number of times, and the warm-up controller continues the warm-up operation until the warm-up correction coefficient reaches 1.0.

6. The apparatus according to claim 3, wherein the warm-up correction coefficient is composed of a multiplication term equal to or greater than 1.0 and set to decrease toward 1.0 by the predetermined value every time the predetermined time period elapses, and the warm-up controller continues the warm-up operation until the warm-up correction coefficient reaches 1.0.

7. A method for controlling a general-purpose internal combustion engine connectable to an operating machine to be used as a prime mover of the machine, having the steps of:

regulating a throttle opening of a throttle valve installed in an air intake pipe of the engine such that a speed of the engine is converged to a desired engine speed set by an operator;

calculating a basic fuel injection amount based on the engine speed and the throttle opening; and controlling warm-up operation of the engine by correcting the calculated basic fuel injection amount with a warm-up correction coefficient to calculate a warm-up time fuel injection amount after start operation of the engine is completed and injecting fuel from an injector by the calculated warm-up time fuel injection amount, wherein the improvement comprises the steps of:

searching for a searched fuel injection amount with which an output of the engine becomes maximum based on the throttle opening regulated in response to increasing/decreasing operation of the warm-up time fuel injection amount conducted when the engine speed is constant; and correcting the warm-up correction coefficient using the searched fuel injection amount, and wherein the step of searching searches for the fuel injection amount with which the output of the engine becomes maximum based on a minimum value of the throttle opening regulated in response to the increasing/decreasing operation of the warm-up time fuel injection amount.

8. The method according to claim 7, wherein the warm-up correction coefficient is set to decrease by a predetermined value every time the engine is rotated a predetermined number of rotations.

9. The method according to claim 7, wherein the warm-up correction coefficient is set to decrease by a predetermined value every predetermined time period.

10. The method according to claim 7, wherein the step of searching searches the fuel injection amount with which the output of the engine becomes maximum by increasing/decreasing the warm-up time fuel injection amount every prescribed time period.

11. The method according to claim 8, wherein the warm-up correction coefficient is composed of a multiplication term equal to or greater than 1.0 and set to decrease toward 1.0 by the predetermined value every time the engine is rotated the predetermined number of times, and the step of controlling continues the warm-up operation until the warm-up correction coefficient reaches 1.0.

12. The apparatus according to claim 9, wherein the warm-up correction coefficient is composed of a multiplication term equal to or greater than 1.0 and set to decrease toward 1.0 by the predetermined value every time the predetermined time period elapses, and the step of controlling continues the warm-up operation until the warm-up correction coefficient reaches 1.0.

* * * * *